United States Patent [19]

Cleary

[11] 4,331,726

[45] May 25, 1982

[54] ROOFING COMPOSITION AND STRUCTURE

[76] Inventor: Patrick J. Cleary, 9107 S. Bell Ave., Chicago, Ill. 60620

[21] Appl. No.: 201,281

[22] Filed: Oct. 27, 1980

Related U.S. Application Data

[63] Continuation-in-part of Ser. No. 48,091, Jun. 13, 1979, abandoned.

[51] Int. Cl.[3] ..... B32B 5/18

[52] U.S. Cl. ..... 428/143; 428/317.9; 521/54; 521/55; 521/91; 521/139; 523/218

[58] Field of Search ..... 428/143, 317.9; 521/53, 521/54, 55, 91, 139

[56] References Cited

U.S. PATENT DOCUMENTS

| | | | |
|---|---|---|---|
| 3,251,916 | 5/1966 | Newnhorn et al. | 521/86 |
| 3,338,848 | 8/1967 | Hamilton | 521/78 |
| 3,697,366 | 10/1972 | Horlock et al. | 521/55 |
| 3,711,431 | 1/1973 | Vargiu et al. | 521/82 |
| 3,896,060 | 7/1975 | Plunquian | 521/54 |
| 3,917,547 | 11/1975 | Massey | 521/54 |
| 4,100,242 | 7/1978 | Leach | 521/56 |

*Primary Examiner*—Morton Foelak

*Attorney, Agent, or Firm*—Hill, Van Santen, Steadman, Chiara & Simpson

[57] ABSTRACT

A pourable roofing composition composed of chopped discrete small chunks or pieces of closed cell plastics material, such as polystyrene, polyurethane, and the like; inexpensive granular or powder particles of fly ash or the like inert particulate material which will hold down the light cellular plastic pieces; and an emulsion caulking or sealing type binder or adhesive capable of setting under atmospheric conditions to seal the composition into an all weather resisting waterproof layer. Suitable binders or adhesives are liquid based emulsions of acetates, acrylic resins, epoxy adhesives, and the like. The composition is flowable, can be premixed remote from the building or use site, can be transported to the site in a concrete mixer type truck, and can thereafter be spread over a roof base and screed to the desired contour and level. After an initial set, an overcoat of a sealer such as an acrylic resin-type sealer can be applied.

15 Claims, 3 Drawing Figures

ROOFING COMPOSITION AND STRUCTURE

RELATED APPLICATION

This application is a continuation-in-part of my copending U.S. patent application Ser. No. 48,091, filed June 13, 1979, now abandoned entitled "Roofing Composition and Structure".

BACKGROUND OF THE INVENTION

1. Field of the Invention

This invention relates to building materials, and more particularly to roofing compositions.

2. Prior Art

Historically the most popular modern flat roof composition is a built-up layered mat of tar paper, felt, etc., and asphalt or tar. Construction of such layered roofs is time-consuming and with recent increases in costs of petroleum products, has become quite expensive. Additionally, such layered roofs are difficult to provide with desired contours and slopes, are subject to deterioration from weathering, and have little thermal insulation benefits due to the great expense in constructing them thick enough to provide insulation.

It has been known in the art to provide a roofing compound, particularly as an insulating layer, as part of the roof. Such insulating layer compounds include both rigid insulation slabs or pads which are laid atop the roof base and thereafter covered with a standard laid up roof and wet or dry-type compounds which are poured or otherwise applied to the roof base and thereafter contoured to the desired roof contour. Such known arrangements include loose fill materials compacted by rollers or the like as well as insulating concrete materials which are poured and set.

Primarily such insulation compounds do not provide final roofing covers but rather are later covered with a standard laid up roof.

Other roofing structures include membrane roofs using plastic, rubber or pre-constructed lay-ups which are applied either with single layers or as multiple layers with or without overlying and/or underlying insulation.

A common feature of the majority of prior art insulating roof compounds is that they do not constitute a roofing surface but rather constitute merely a single layer of a multi-layer roofing surface. Moreover they are not weather resistant, and are expensive to obtain and install.

It would therefore be an improvement in the art to provide a roofing composition having high insulation properties which is capable of being directly applid to a roof base, being conformable to roof contours and desired slopes and which, when set, is capable of providing a final or finished roof.

SUMMARY OF THE INVENTION

It is therefore a principal object of this invention to provide an improved roofing composition.

It is another, and more specific object of this invention, to provide a roofing composition having high thermal insulation properties.

It is yet another, and more specific object of this invention, to provide a roofing composition which can be premixed remote from the building site, pumped or otherwise moved from a delivery truck to a roof, poured or screed into a desired roof contour and which will thereafter set to a film roof having weather resistant properties.

It is another, and more specific object of this invention, to provide a roofing composition which can be applied semi-moist, which will thereafter set to a uniform roof, which does not need a laid up or membrane roof overcoat, and which is weather resistant and has relatively high insulating properties.

It is another, and specific object of this invention, to provide a roofing composition composed of discrete pieces of foamed closed cell polyurethane or polystyrene resin, inexpensive inert powder or granular material such as fly ash, and an emulsion binder for the resin and ash ingredients which will set under atmospheric conditions to caulk and seal the pieces and particles.

This invention fulfills each of the above objects by providing a roofing composition composed of a mixture of chopped pieces of closed cell foamed plastics material, such as polystyrene or polyurethane, heavier inert particles of inexpensive filler material such as fly ash, and an emulsion binder which will set up under atmospheric conditions to bind together and seal the mixture into a water-proof weather-resisting layer. The composition may be pre-mixed remote from the use site, transported to the use site in a standard concrete mixer-type truck, and poured or pumped to the use site to form the weatherproof roof. The composition may be applied directly on top of the roof base of a building such as a metal deck, a concrete deck, precast concrete sections, precast concrete beams or channels, or other roof constructions. The composition can be applied over an under layer sealer such as a sheet or plastic coat or can be applied directly to the base. The composition is applied in a fully flowable condition and will conform with the roof contour. It is thin enough to fill cracks, gaps or undulating contours and can be screed or otherwise formed to the desired roof shape or slope. It can be built up at the edges and can be applied in any desired thickness. The composition exhibits good insulating capacity so that a sufficiently thick layer will avoid the necessity of using other external insulation for the building roof.

In a preferred embodiment water may be added to the compound to limit the agglomeration and to reduce stickiness.

Other objects, features, and advantages of the invention will be readily apparent from the following description of the preferred embodiments thereof, taken in conjunction with the accompanying drawings, although variations and modifications may be effected without departing from the spirit and scope of the novel concepts of the disclosure, and in which:

DESCRIPTION OF THE PREFERRED EMBODIMENTS

Figure 1:
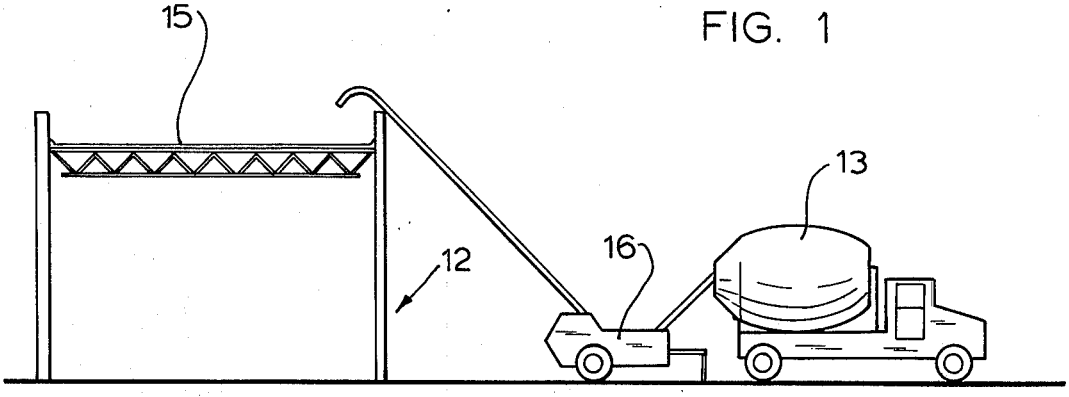
FIG. 1 is a schematic view of a method of applying the roofing compound of this invention.

The roofing composition of the present invention is preferably formed as a mixture of chopped pieces of closed cell foamed plastics material, fly ash, and an emulsion binder which sets up under atmospheric conditions to seal together the plastic pieces and fly ash particles into a weather-resisting water-proof layer or mat. The closed cell foamed plastics material may be a polystyrene, a polyurethane, or the like which can be economically obtained as a waste material from forming operations which use such plastics material in the manufacture of other items. For example, a large quantity of such material is presently available as waste from the forming of articles by trimming or cutting the articles from sheets of the material. This creates a large amount of waste scrap ideally suited for the plastics material component of the compositions of this invention.

The second ingredient, fly ash, is a standard waste material, readily available in large quantities from commercial power plants and the like. Being a waste commodity it is practically free in cost and being inert it combines with the plastics material to form the very desirable weather-resistant roof. The fly ash adds bulk and strength to the plastics material.

The third ingredient, is an emulsion binder forming a homogeneous mixture of the fly ash and the foamed plastics material and then setting under atmospheric conditions to caulk and seal the ingredients into a water-proof mat or layer. In general, water-based latex caulking compounds and sealants are useful and available under such trade names as "Rhoplex" Acrylic Emulsion for Aqueous Caulks and Sealants supplied by Rohm and Haas Company of Philadelphia, Pa., "Elvace" acetate-/ethylene copolymer emulsion furnished by DuPont Company of Wilmington, Del. These emulsions can be latex based, of relatively high solids content (40–65%) of monomers such as styrenes, acrylic nitrites (particularly methyl acrylate), vinyl acetates, vinyl chlorides and the like latices. Such compositions will dry and set up under atmospheric conditions by cross-linking and polymerization, caulking and sealing together the plastics pieces and fly ash particles into a water-proof wear-resisting layer or mat.

The mixture of the three primary ingredients exhibit some surprising properties. First, the mixture remains fluid for sufficiently long periods of time to allow it to be mixed remote from the building site, trucked to the building site, and either poured or pumped onto the roof base. Due to the fluid nature of the mixture, it is easily spread and screed to the desired contours. Moreover, the mixture, again due to its fluid state, will evenly coat the roof irrespective of the roof underlayment. Thus, the mixture conforms to the roof surface, fills all gaps, cracks and undulations, can be screed to a desired slope, and yet is viscous enough so that it will not flow down high slopes. The composition can be built-up on arcuate curves at the edges of the roof, around window openings, or the like. Preferably, the foam plastics material is a closed cell polystyrene which has been modified to make it fire-resistant. Such modified polystyrenes are known in the trade and in general, the polystyrene has added to it, prior to the foaming, materials which will cause it to be self-extinguishing. One known method is to add chlorinated rubber to the polystyrene base. The particular modification of the plastics material to render it flame-resistant constitutes no part of my invention.

The composition of this invention, when set, accommodates hot and cold expansion or contraction as well as thermal expansion and contraction of the building. The set roofing composed of the composition of this invention is firm while retaining resiliency allowing it to be walked upon while its resiliency allows it to conform to building expansion and contraction.

Since the fly ash ingredient is completely inert and the polystyrene is substantially inert, the composition is weatherproof. Moreover, because the binder sets the ingredients into a firm layer or mat it will not lift from the roof in high winds.

A preferred mixture ratio of ingredients of the composition of this invention will be apparent from the following test batch:

approximately 21 cubic feet of $1\frac{1}{2}$ pound density chopped styrofoam (polystyrene) preferably chopped to particles or pieces having a maximum dimension equal to or less than $\frac{3}{8}$ inch is mixed with 7.2 cubic feet (788 pounds) of fly ash. To this mixture 13 gallons (1.74 cubic feet) of an emulsion binder capable of caulking and sealing the styrofoam and fly ash into a water-proof mat under atmospheric conditions, is added. Suitable caulking-type binders and sealants for styrofoam plastics material are commercially available under the trademark "Elvace" (a trademark of DuPont Corporation, Wilmington, Del.) for acetate/ethylene emulsion, and "Rhoplex" (a trademark of Rohm and Haas Company, of Philadelphia, Pa.) for acrylic emulsions. In general, the binders are water-based or water-extended and set by polymerization and cross-linking under atmospheric conditions within a few hours. The term "copolymer emulsion binder" is used herein to designate such known caulking type binders and sealants which set under atmospheric conditions.

In a preferred embodiment, to the above mixture, may be added up to 34 gallons (4.5 cubic feet) of water to limit agglomeration and stickiness.

By volume, a desirable composition of this invention has about one part binder to four parts fly ash to twelve parts chopped styrofoam and to this may be added up to 2.5 parts of water.

A specific "copolymer emulsion binder" is an acrylic emulsion available from the Rohm and Haas Company under the name "Rhoplex LC-40" which is believed to be a copolymer of methacrylic acid esters having a chemical base as follows:

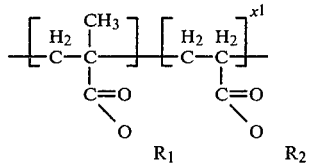

wherein $R_1$ and $R_2$ are lower primary alcohols.

The mixture may be transported to the job site by a concrete mixer or the like truck and can thereafter be pumped to the roof through a standard concrete pump. Of course, the mixture can also be made on site if desired.

As a second example of a preferred mixture the following was prepared:

10 cubic feet of $1\frac{1}{2}$ pound density (per cubic foot) styrofoam fine chopped having a maximum length in any dimension of $\frac{3}{8}$ inch; 10 cubic feet of $1\frac{1}{2}$ pound density (per cubic foot) styrofoam chopped coarse having a maximum length of $\frac{1}{2}$ inch in any dimension; approximately $4\frac{1}{2}$ cubic feet (468 pounds) of fly ash; 13 gallons of acrylic copolymer; 3 gallons of a water reducing agent; 0.08 gallons of chlorinated rubber base; and a small amount of fungicide. To this was added up to 18 gallons of water to enhance the flowability of the mixture.

An acceptable water reducing agent may be volcanic ash. Acceptable chlorinated rubbers may be polymers of the type $(C_{10}H_{11}Cl_7)n$. Polymers of this type are available from the Sherman Williams Paint Company of Chicago, Ill.

The preferred water reducing agent used in the above described second embodiment was a well known liquid accelerator for concrete sold under the trademark "Pozzolith" by Master Builders of Cleveland, Ohio, a division of the Martin-Marietta Company. These compositions are liquid admixtures of Pozzolanas obtainable from silicious material of volcanic origin, glass furnace slag, and the like. These materials react with lime in the presence of water to produce a cementatious compound. Addition of these agents allow the same flowability characteristics to be achieved with lesser amounts of water and reduce the set time and lighten the material being pumped. The chlorinated rubber was obtained from Rohm and Haas Corporation and is sold as chlorinated rubber base. It increases the fire resistance of the composition. The fungicide was added primarily because certain acrylic copolymer emulsion binders have a tendency to support micro-organisms.

After application and screeding the mixture is allowed to set. The build up of the mixture is both dependent upon the nature of the roof desired, the slope of the roof to be applied and the extent of insulation properties desired. The roof may, for example, be built up with from 2 to 6 inches of the mixture.

The resultant compound sets in approximately the same time as concrete and has been found to be firm enough to walk upon in 3 to 5 hours.

Although in the preferred mixture water has been used, the compound sets without use of water if desired. The compound does not exhibit hydration and, when properly set, is substantially water impervious.

Further, I have found that the appearance of the roof and its weather resistant properties can be enhanced by applying a final overcoat of the same acrylic emulsion used in the mix. The overcoat also aids in protecting the mixture. The binder emulsion, preferably an acrylic, when used as an overcoat, will exhibit sufficient resiliency to maintain coherence with the resilient roofing mixture. Specifically, I have found that even with the composition of the first above described specific example, the final overcoat can advantageously be an emulsion binder having added to it the chlorinated rubber base and fungicide described in connection with the second specific example. When using the final overcoat, it is preferable to delay application until substantially all of the water has evaporated from the roofing composition.

It is not necessary, when using the above roofing compound, to apply any further roofing. Specifically the necessity of using the heretofor used membrane or laid up roofing is eliminated.

As illustrated in the drawings, the roofing compound of this invention 10 consists of a substantially homogeneous mixture 11 of closed cell foamed plastic, fly ash, and emulsion binder. The mixture may be transported to the job site 12 by a concrete mixing truck 13 and thereafter pumped to the roof 15 by suitable means such as a standard concrete pump 16.

Figure 2:
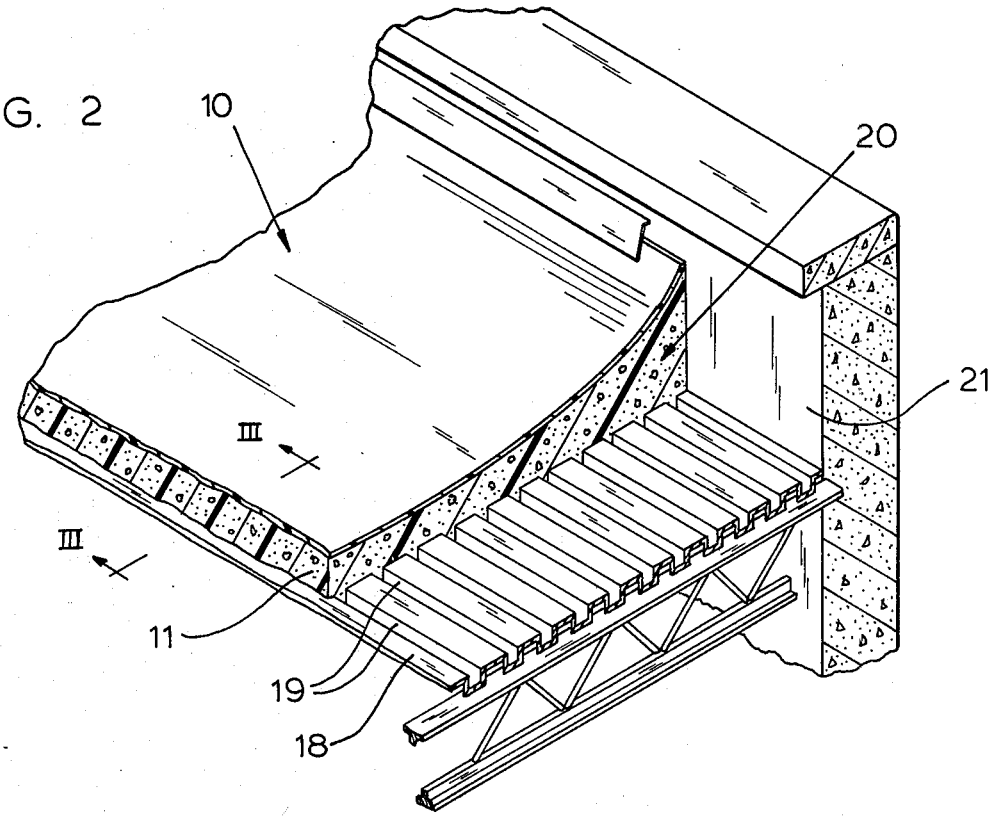
FIG. 2 is a fragmentary cross-sectional view of a roof portion of a structure roofed with the compound of this invention.

The roof is prepared for receipt of the mixture in any standard building manner. For example, a metal corrugated type roofing 18 may be utilized as a standard roof base. A preferred roofing deck is a G60 galvanized roof deck. Advantageously, the mixture disclosed herein will fill the grooves 19 of such corrugated roofing. Moreover, as shown in FIG. 2, the roofing may be built up to any desired level and can be sloped or tapered as shown at 20 to provide whatever contours are necessary for drainage or aesthetics. For example, the roof can be sloped upwardly at outside walls 21 and pitched to a central or peripheral drainage system.

Figure 3:
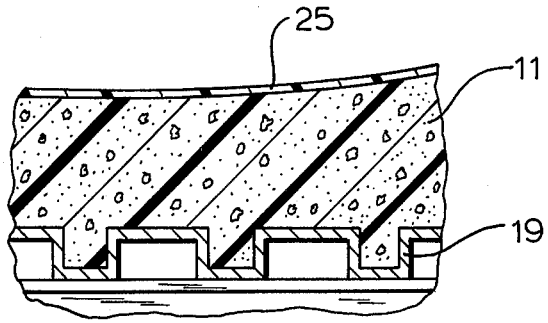
FIG. 3 is an enlarged fragmentary cross-sectional view of a roof formed from the compound of this invention.

As best shown in FIG. 3, the composition, when properly applied, will fully conform to the various contours of the base, filling all major cracks, roof joints, etc. The compound roof 11 may when desired, be provided with a final coat or seal skin 25 which preferably would consist of the same or a similar acrylic emulsion as is used for the mix binder.

I have provided a mixture according to the above formulation and I have found that the mixture can, if desired, be preformed into slabs, sheets or bricks. I have further found that the setting time is sufficiently prolonged as to allow transportation from a separate mixing site to a building site a distance substantially consistent with present day concrete practice. Moreover, I have found that the mixture, when premixed with water to prevent agglomeration and reduce stickiness, is not adversely effected by that water during the curing. Apparently the water evaporates out of the mixture at a rate which, although perhaps slightly slowing curing time, does not adversely effect the set of the mixture. The resultant composition, when fully set, in a brick of approximately 4 inch depth, has been tested to a compression resistance of 44 pounds per square inch with high resiliency at lower pressures.

It can therefore be seen from the above that my invention provides a new roofing composition which substantially eliminates many of the disadvantages of presently used roofing structures. Surprisingly, with a pourable roofing compound, I have been able to provide a roof structure which is weather resistant, of good insulating qualities, easily applied, quickly set and of sufficient strength and compression resistance to support normal roof activities while retaining adequate resiliency to compensate for building structure expansion and contraction.

In the above described preferred embodiment I have set forth specific examples. However, the relationship between materials disclosed in that example may be modified for different situations. Basically I believe that an acceptable roofing structure can be economically made anywhere within a range of, by volume, 50 to 70% foamed plastic material to 20 to 40% fly ash to 5–10% binder. The specific amount of emulsion binder to be utilized is dependent upon a number of factors, including the specific mixture of dry ingredients, the desired time to setting, the specifics of the emulsion binder used, and whether or not water is added. For example, with an acrylic emulsion having a smaller percentage of solids than that which I have used, a larger quantity of binder per cubic foot of dry ingredient may be desirable. To the above basic mixture water may be added.

The amount of water to be added is dependent upon environmental factors, the quantity and quality of the binder used, and the degree of flowability required.

Although the teachings of my invention have herein been discussed with reference to specific theories and embodiments, it is to be understood that these are by way of illustration only and that others may wish to utilize my invention in different designs or applications.

I claim as my invention:

1. A roofing composition consisting essentially of a mixture of closed cell chopped foamed plastics material, fly ash and an aqueous acrylic copolymer emulsion binder.

2. A roofing composition comprising a mixture of chopped closed cell polystyrene, fly ash and an aqueous acrylic copolymer emulsion binder, said mixture being initially flowable, and setting to a firm but resilient structure.

3. The roofing composition of claim 2 wherein the mixture is initially provided with added water, the water substantially evaporating during setting.

4. A roof structure for buildings comprising a roof base, a relatively thick layer of a roofing mixture applied over the base, the roofing mixture comprising a mixture of chopped closed cell polystyrene, fly ash and an aqueous acrylic copolymer latex emulsion binder.

5. The structure of claim 4 wherein the polystyrene is a foamed material chopped to particles having an average maximum dimension of approximately $\frac{3}{8}$ inch.

6. The structure of claim 5 wherein an overcoat of acrylic emulsion is applied on top of the mixture.

7. A roofing composition comprising a mixture of from 50 to 75% by volume chopped closed cell polystyrene particles, 20 to 40% by volume fly ash, and sufficient liquid aqueous acrylic copolymer settable emulsion to thoroughly bind the polystyrene and fly ash together in a firm but resilient structure upon setting of the emulsion.

8. The roofing of claim 7 wherein the polystyrene is chopped having an average maximum dimension of $\frac{1}{2}$ inch.

9. The roofing of claim 8 wherein the mixture is initially prepared with water.

10. The composition of claim 7 wherein the mixture is approximately 70.5% by volume chopped closed cell polystyrene, 23.5% by volume fly ash and 6% by volume liquid settable acrylic emulsion binder.

11. The composition of claim 4 wherein the polystyrene is modified to be flame resistant.

12. The structure of claim 11 wherein flame resistant materials are added to the mixture.

13. The structure of claim 12 wherein the flame resistant materials constitute chlorinated rubber.

14. A composition according to claim 8 wherein a portion of the polystyrene has a maximum dimension of $\frac{3}{8}$ of an inch and where there is added to the mixture approximately 1 part chlorinated rubber to 16 parts acrylic emulsion.

15. The composition of claim 3 including a water reducing agent.

* * * * *